US005414985A

United States Patent [19]

Ball et al.

[11] Patent Number: 5,414,985

[45] Date of Patent: May 16, 1995

[54] PROCESS AND APPARATUS FOR PIECING A THREAD IN OPEN-END SPINNING

[75] Inventors: Anthony Ball, Ilmmunster; Ulrich Rodiger, Ingolstadt, both of Germany

[73] Assignee: Schubert & Salzer Maschinenfabrik AG, Ingolstadt, Germany

[21] Appl. No.: 303,600

[22] Filed: Sep. 9, 1994

Related U.S. Application Data

[63] Continuation of Ser. No. 923,792, Aug. 26, 1992, abandoned.

[30] Foreign Application Priority Data

Mar. 1, 1991 [DE] Germany ..... 41 06 556.5

[51] Int. Cl.[6] ..... D01H 4/50

[52] U.S. Cl. ..... 57/263; 57/411

[58] Field of Search ..... 57/263, 408, 409, 411, 57/412, 413

[56] References Cited

U.S. PATENT DOCUMENTS

| | | | |
|---|---|---|---|
| 3,728,853 | 4/1973 | Schiltknecht . | |
| 3,842,579 | 10/1974 | Bartling . | |
| 3,953,961 | 5/1976 | Harrap et al. | 57/411 X |
| 4,020,621 | 5/1977 | Tsubata . | |
| 4,047,371 | 9/1977 | Stahlecker . | |
| 4,055,942 | 11/1977 | Stahlecker | 57/263 |
| 4,059,946 | 11/1977 | Bottcher et al. . | |
| 4,109,453 | 8/1978 | Kobayashi et al. | 57/412 X |
| 4,150,530 | 4/1979 | Derichs . | |
| 4,175,370 | 11/1979 | Stahlecker . | |
| 4,178,749 | 12/1979 | Stahlecker et al. . | |
| 4,395,870 | 8/1983 | Neher et al. . | |
| 4,489,544 | 12/1984 | Mirita et al. . | |
| 4,495,762 | 1/1985 | Junek et al. | 57/411 |
| 4,497,166 | 2/1985 | Artzt et al. . | |
| 4,633,660 | 1/1987 | Artzt et al. . | |
| 4,644,742 | 2/1987 | Lovas et al. . | |
| 4,676,059 | 6/1987 | Artzt et al. | 57/263 |
| 4,712,367 | 12/1987 | Lassmann . | |
| 4,825,631 | 5/1989 | Raasch . | |
| 4,893,462 | 1/1990 | Braun et al. | 57/263 X |
| 4,901,519 | 2/1990 | Wassenhoven et al. . | |
| 4,976,099 | 12/1990 | Brockmanns et al. | 57/411 |
| 4,998,404 | 3/1991 | Ferro et al. | 57/263 |

FOREIGN PATENT DOCUMENTS

| | | | |
|---|---|---|---|
| 42906 | 1/1982 | European Pat. Off. | 57/263 |
| 3516120 | 11/1986 | Germany . | |
| 71433 | 4/1984 | Japan . | |

*Primary Examiner*—Joseph J. Hail, III
*Attorney, Agent, or Firm*—Dority & Manning

[57] ABSTRACT

For piecing a thread in an open-end spinning apparatus having a fibre collection surface, a sliver is supplied to the clothing of an opening cylinder and opened thereby into fibres and is supplied in this form to the fibre collection surface. There, the fibres are incorporated into the end of a returned thread which is then drawn off continuously. During this, the leading end of the sliver, forming a tuft, is supplied for piecing to the opening cylinder, at a penetration depth which is greater than the penetration depth after piecing, whereas piecing is carried out in a manner conventional per se, matched to a reduction in the penetration depth. This reduction in the penetration depth is carried out suddenly in order to counter thick points in the joint. To carry out the process, a penetration depth alteration apparatus is provided which is in controlled connection with a control apparatus.

17 Claims, 7 Drawing Sheets

PROCESS AND APPARATUS FOR PIECING A THREAD IN OPEN-END SPINNING

This is a continuation of application U.S. Ser. No. 07/923,792, filed Aug. 26, 1992, which was abandoned upon the filling hereof.

BACKGROUND OF THE INVENTION

The present invention relates to a process for piecing a thread in an open-end spinning apparatus having a fibre collection surface, in which process a sliver is supplied to the clothing of an opening cylinder and is opened thereby into fibres and is supplied in this form to the fibre collection surface, where the fibres are incorporated into the end of a returned thread which is then drawn off continuously, and to an apparatus for carrying out this process.

When piecing, the problem arises that on the one hand the returned thread end and the supplied fibres form an overlapping point which forms a thick point in the joint. On the other hand, the thread must be accelerated to production draw-off speed. If this acceleration takes place too slowly, then a thick point is again produced in the joint. However, if this acceleration takes place too quickly, then there is a risk of thread breakage because of the high draw-off tension. To solve these problems, it is known from WO 88/10990 to determine the combing state of the tuft and to match the thread draw-off to the effectiveness of fibre supply to the fibre collection surface. It is furthermore known from this specification to begin the drawing off of the thread at a low acceleration even before the fibres reach the fibre collection surface and only after the fibres then supplied to the fibre collection surface have contacted the thread end to increase the rate of drawing off of the thread. In this way, although a substantial reduction in the thick point in the joint is achievable, the joint is still disruptive for certain purposes.

SUMMARY OF THE INVENTION

It is thus the object of the present invention to provide a process and an apparatus with the aid of which the joint can be formed in an even less obtrusive manner.

In accordance with the invention, this object is achieved in that the leading end of the sliver, forming a tuft, is supplied for piecing to the opening cylinder, at a penetration depth which is greater than the penetration depth subsequently after piecing, whereas piecing is carried out in a manner conventional per se, matched to a reduction in the penetration depth. By altering the penetration depth of the tuft, the relationship between fibre supply and drawing off of the thread is briefly altered by comparison with the corresponding relationships before and after this change in the tuft penetration depth, such that temporarily fewer fibres reach the fibre collection surface. This results in the point in the thread corresponding to this fibre deposition being thinner than otherwise, so that in this way thick points can be countered.

Advantageously, this reduction in the penetration depth is timed such that the fibre supply to the fibre collection surface starts up at the beginning of reduction in the penetration depth of the tuft into the clothing of the opening cylinder. In this way, the reduction in the penetration depth counters the conventional thick point caused by the overlap of thread end and newly supplied fibres, so that thick points are minimized.

In order to achieve a thread thickness which corresponds to the desired thread thickness not only in the narrower joiner region but also subsequently, advantageously drawing off of the thread is controlled to be matched to the arrival of the fibre supply to the fibre collection surface, which arrival is reduced by the reduction in the penetration depth of the tuft.

In accordance with a further advantageous development of the process according to the invention, it is provided for the drawing off of the thread already to begin before the penetration depth of the tuft into the clothing of the opening cylinder is reduced. As a result of this, an even better compensation of an otherwise possible thick point in the joiner is achieved while simultaneously smoothly accelerating drawing off of the thread.

In order that the thread draw-off behaviour can be matched to the arrival behaviour of the fibre supply, advantageously the state of the tuft is determined at the beginning of piecing and the start and/or the acceleration profile of the drawing off of the thread is matched to the state of the tuft in such a way that if the tuft is combed out to a greater extent the drawing off of the thread begins later and/or arrives at a lower acceleration than with a tuft which is combed out to a lesser extent.

The reduction in the penetration depth is particularly effective if, in accordance with a further advantageous embodiment of the process according to the invention, the procedure is such that the tuft, directly before its return movement from the increased penetration depth, is at least approximately in a state of equilibrium between fibres combed out per unit of time on the one hand and fibres supplied with the sliver on the other hand.

It has proved advantageous if the difference between the increased penetration depth and the reduced penetration depth after piecing is chosen such that a reduction in thread thickness of at least 10% is effected directly after the sudden return movement of the tuft to the reduced penetration depth. Preferably, however, the difference is chosen such that the reduction in thread thickness is between 10 and 30%.

A particularly effective prevention of excess fibres, which conventionally lead to thick points in the joint, can be achieved by a sudden reduction in the penetration depth of the tuft into the clothing of the opening cylinder.

A procedure according to the invention in accordance with which the reduced penetration depth of the tuft into the clothing of the opening cylinder is maintained for production has proved particularly favourable from the point of view of apparatus and control.

If the larger penetration depth of the tuft into the clothing of the opening cylinder is also the penetration depth which the tuft adopts during production, so that the reduced penetration depth is provided only temporarily for the tuft, then in a further embodiment of the process according to the invention, it is provided that the penetration depth of the tuft into the clothing is increased again after piecing to the initial value, and this penetration depth is then maintained for production. In this way, thin points which would otherwise occur downstream of the joint can be minimized. If at the same time changes in the number are to be avoided, since no such thin point is to be compensated, then once the fibre supply, following the reduction in the penetration depth, has again at least substantially adopted the value corresponding to production, the increase in the penetration depth can be carried out so slowly that during the increase in penetration depth the quantity of fibres combed out by the opening cylinder per unit of time is virtually unchanged.

In principle, control of the penetration depth of the tuft into the clothing of the opening cylinder can be controlled in various ways, but it has proved particularly advantageous if the tuft is to this end subjected to a controllable air flow.

Advantageously, for the pneumatic control of the penetration depth of the tuft into the clothing of the opening cylinder, it is provided that, to increase the penetration depth downstream of the region in which the tuft is supplied to the opening cylinder, an underpressure is brought into effect which exceeds the underpressure which is effective after piecing.

Although it is possible to have the increased underpressure effective in the region of the fibre collection surface as well, it has proved particularly advantageous to bring the increased underpressure effective downstream of the region at which the tuft is supplied to the opening cylinder into effect at a point at which the fibres have not yet reached the fibre collection surface.

In order to prevent fibres which have been impaired during the stoppage of the open-end spinning apparatus concerned which precedes piecing from reaching the fibre collection surface and being incorporated into the returned thread end during piecing, it is advantageous to guide away the fibres until the penetration depth of the tuft is reduced without them first having reached the fibre collection surface and only to supply them to the fibre collection surface when the penetration depth has been reduced.

In accordance with the invention, it can be provided in a simple way that the reduction in the underpressure is effected by switching off an air flow exceeding the spinning underpressure and by switching on a weaker air flow effective at the fibre collection surface.

In order to achieve a particularly effective minimization of thick points, in a further embodiment of the process according to the invention, it is provided that the reduction in the penetration depth is effected not only as suddenly as possible but also by as large a value as possible, in that until the time of reducing the penetration depth of the tuft into the clothing of the opening cylinder, the underpressure effect is kept at a value which ensures the increased penetration depth and which is perceptibly higher than the underpressure after piecing.

In accordance with the invention, for the sake of simplicity, the increase in the penetration depth of the tuft is effected by switching on an air flow and the reduction is effected by switching it off again.

As already mentioned, although pneumatic control of the penetration depth of the tuft into the clothing of the opening cylinder is particularly advantageous, it is also quite possible to control the penetration depth mechanically. To this end, it can be provided that the alteration in the penetration depth of the tuft is effected by adjusting a feed apparatus which supplies the sliver to the opening cylinder, or a part of the feeding apparatus. In accordance with a further alternative development of the process according to the invention, the penetration depth of the tuft may also be altered by adjusting a mechanical baffle Which is provided between the feed apparatus which supplies the sliver to the opening cylinder and the opening cylinder.

In order to carry out the process, in accordance with the invention there is provided a penetration depth alteration apparatus which controls the penetration depth of the tuft into the clothing of the opening cylinder, is connected, as far as control is concerned, to the control apparatus and is able to influence the flow of fibres to the fibre collection surface by altering the penetration depth of the tuft into the clothing of the opening cylinder.

In order that a sudden effect of an alteration in the penetration depth of the tuft into the clothing of the opening cylinder and thus in the flow of fibres can be achieved, in accordance with the invention the penetration depth alteration apparatus is adjustable in a sudden manner at least in one of the two alteration apparatus. Here, the penetration depth alteration apparatus is preferably constructed as penetration depth increasing apparatus which can be made ineffective suddenly.

Preferably, the penetration-depth alteration apparatus is controlled pneumatically, and in accordance with an advantageous embodiment of the subject of the invention the penetration depth alteration apparatus has an overpressure source which is in controlled connection with the control apparatus and which opens in the longitudinal region of the tuft into the housing of the opening cylinder.

In accordance with an alternative and similarly advantageous embodiment of the apparatus according to the invention, the penetration depth alteration apparatus has an underpressure source which is in controlled connection with the control apparatus and which can be brought into effect in the housing of the opening cylinder.

In accordance with a further development of the subject of the invention, it can be provided that the underpressure source associated with the fibre collection surface and the underpressure source serving as adjustment apparatus together form the penetration depth alteration apparatus and may be brought into effect in an overlapping manner. When the two underpressure sources operate in overlapping manner, an increased underpressure is produced which draws the tuft into the clothing of the opening cylinder in an intensified manner and which, when it is switched off, allows the tuft to return to its shallower penetration position.

Preferably, the penetration depth alteration apparatus may be brought into effect in the fibre transport path between the feed apparatus and the fibre collection surface.

In principle, the underpressure sources may open into the opening cylinder housing at different points, e.g. in an end wall, but in accordance with the invention it is preferably provided that the underpressure source is connected or may be connected to a suction-air opening provided in the peripheral wall of the housing of the opening cylinder.

In accordance with an embodiment of the invention, the suction-air opening is arranged in the longitudinal region of the tuft, advantageously covered by a screen so that the fibres cannot be sucked out.

In order that fibres which have been sucked out can be caught, there is provided between the suction-air opening and the underpressure source a fibre collection container.

In order that the jump between the two extreme penetration depths of the tuft can be increased, in a further embodiment of the apparatus according to the invention the suction-air opening may selectively be brought into connection with the underpressure source and an overpressure source, in which case, in one setting of the penetration depth alteration apparatus it is the underpressure source which is brought into effect, and in the other setting it is the overpressure source which is brought into effect.

Regardless of whether the penetration depth is controlled by overpressure or underpressure, the overpressure or underpressure source can be connected to the interior of the opening cylinder, which has a perforated outer surface.

In an alternative embodiment of the subject of the invention, the underpressure or overpressure source can open into a feed trough forming part of the feed apparatus and may be directed substantially radially with respect to the clothing of the opening cylinder.

If, for piecing, a maintenance apparatus which can move along a plurality of similar open-end spinning apparatus is provided, then the control apparatus and—in the case of pneumatic adjustment apparatus—also the adjustment apparatus for the penetration depth alteration apparatus may be arranged on this maintenance apparatus.

In the case of a mechanical construction of the penetration depth alteration apparatus, it is advantageously provided that the penetration depth alteration apparatus has an adjustment apparatus for the feed apparatus or a part thereof or an adjustable baffle arranged in the region of the tuft.

In order that the drawing off of the thread can be matched to the optimum to the fibre supply acting on the fibre collection surface, it is advantageous if an apparatus, which is in controlled connection with the piecing apparatus, is provided for determining the state of the tuft at the beginning of the piecing procedure and is connected to the control apparatus. Here, the apparatus for determining the state of the tuft is connected by way of the control apparatus to the timer element for the penetration depth alteration apparatus.

With the aid of the process and the apparatus according to the present invention, it is possible to achieve brief alterations in the quantity of fibres supplied, acting on the fibre collection surface in order thus to compensate for thick points or indeed thin points in the thread and thus to minimize them. By appropriate time control of the alteration in the penetration depth, by means of which the tuft is supplied to the clothing of the opening cylinder, it is possible to counter, in a controlled manner, a technologically caused thick point or thin point in the joint or in the adjoining thread breakage. Here, the solution is simple both as regards its construction and its control. It can also be incorporated in simple manner into already existing machines.

BRIEF DESCRIPTION OF THE DRAWINGS

A number of embodiments of the invention are explained below with the aid of drawings, in which.

DETAILED DESCRIPTION OF THE INVENTION

First, the apparatus for carrying out the process will be described with reference to FIG. 1 insofar as it is necessary to explain the problem to be solved.

Figure 1:
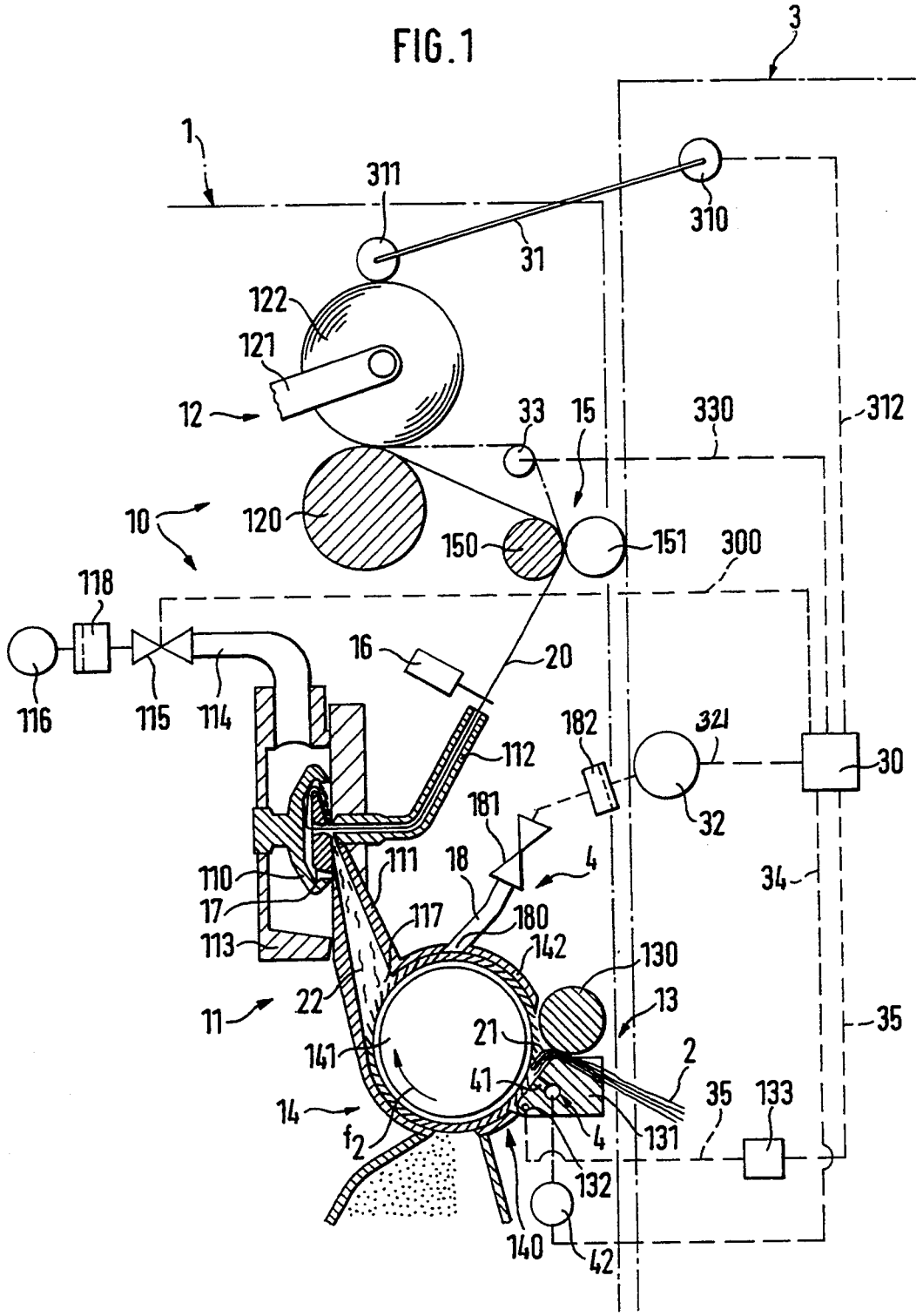
FIG. 1 is a diagrammatic side view of an open-end spinning apparatus having a penetration depth alteration apparatus according to the invention.

FIG. 1 shows on its left-hand side in schematic representation a spinning point 10 of an open-end spinning machine 1. Each spinning point 10 has an open-end spinning apparatus 11 and a bobbin apparatus 12.

The open-end spinning apparatus 11 shown operates with spinning elements constructed as spinning rotors 110, but the invention may also be used to advantage with other open-end spinning machines, e.g. friction spinning machines. Accordingly, the fibre collection surface 17 of the spinning element is formed by the inner peripheral groove of the spinning rotor 110 or a wedge gap of friction rollers or the like, depending on the choice of spinning element.

Each open-end spinning apparatus 11 has a feed or delivery apparatus 13, for supplying a sliver 2, and an opening apparatus 14. The delivery apparatus 13 comprises, in the embodiment shown, a delivery roller 130 with which a feed trough 131 cooperates resiliently. The feed trough 131 is mounted pivotally on a spindle 132.

Figure 2:
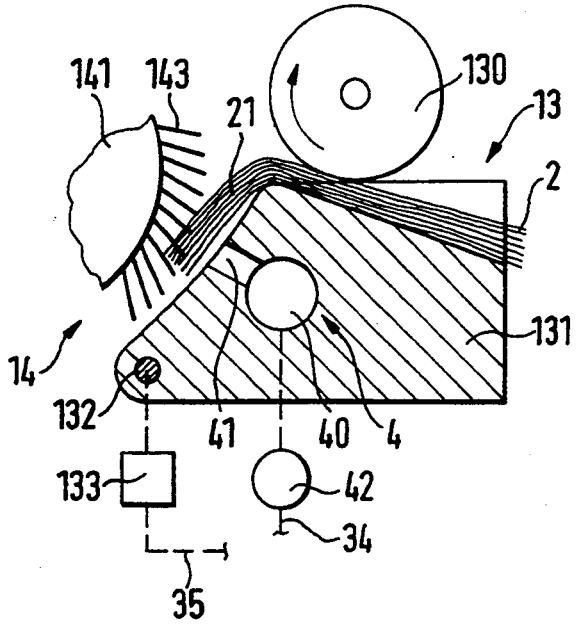
FIG. 2 is an enlarged side view of a penetration depth alteration apparatus which presses the tuft into the clothing of the opening cylinder with an increased penetration depth.

The opening apparatus 14 is, in the embodiment shown in FIG. 1, substantially constructed as an opening cylinder 141 which is arranged in a housing 140 and provided with a clothing 143 (see FIG. 2). A fibre feed channel 111 (see opening 117) extends from roller 141 to the spinning rotor 110, from which a spun thread 20 is drawn off through a thread draw-off tube 112. The latter opens coaxially with the spinning rotor 110 into a housing 113 which surrounds the spinning rotor 110.

To produce the required spinning underpressure, an underpressure line 114 adjoins the housing 113 and is connected, by way of a switching apparatus (switching valve 115) and a fibre collection container 118 in the form of a filter, to an underpressure source 116. The switching apparatus (switching valve 115) is in controlled connection with a control apparatus 30 by way of a line 300.

In addition to this first underpressure line 114, a second underpressure line 18 connected to the open-end spinning apparatus 11 is provided. This second underpressure line 18 ends in a suction-air opening 180 which—as seen in the direction of transport of the fibres (arrow $f_2$)—is provided between the opening 117 of the fibre feed channel 111 and the delivery apparatus 13 outside the fibre transport path in the peripheral wall 142 of the housing 140 for the opening cylinder 141. This second underpressure line 18 is connected by way of a switching apparatus 181 and an underpressure line 321 again to an underpressure source 32. The underpressure source 32 (or a shut-off valve associated therewith) is in controlled connection with the control apparatus 30 byway of a line 320. Also provided in the underpressure line 321 at a suitable point is a fibre collection container 182 in the form of a filter where the fibres 22 which have been sucked away are deposited.

For drawing off the thread 20 from the spinning rotor 110 during the undisrupted spinning procedure, a pair of draw-off rollers 15 having a draw-off roller 150 driven at production speed and, bearing resiliently against the driven draw-off roller 150 and entrained thereby, a draw-off roller 151 are provided. The thread 20 is monitored by a thread monitor 16 on its path between the open-end spinning apparatus 11 and the pair of draw-off rollers 15.

The drawn-off thread 20 then reaches the bobbin apparatus 12 which has a driven bobbin drive roller 120. The bobbin apparatus 12, furthermore, has a pair of pivotal bobbin arms 121 which hold a bobbin 122 rotatably between them. The bobbin 122 bears against the bobbin drive roller 120 during the undisrupted spinning procedure and is consequently driven thereby. The thread 20 to be wound onto the bobbin 122 is inserted in a cross-over thread guide (not shown) which moves back and forth along the bobbin 122 and thus provides the even distribution of the thread 20 on the bobbin 122.

A maintenance apparatus 3 which carries the abovementioned control apparatus 30 for controlling the piecing procedure moves along the open-end spinning machine 1 and its plurality of similar open-end spinning apparatus 11. The control apparatus 30 is connected by way of a line 312 to the drive 310 of a pivot arm 31 which carries at its free end an auxiliary drive roller 311. The auxiliary drive roller 311 is driven by a drive motor (not shown) which, in turn, is in controlled connection with the control apparatus 30 (this connection is not shown). This auxiliary drive roller 311 drives the bobbin 122 for returning the thread 20 for piecing and can also serve to carry out the piecing draw-off until its draw-off has accelerated to the production speed and the further thread draw-off is taken on by the pair of draw-off rollers 15.

There may be associated with the bobbin arms 121 pivot arms (not shown) which are also mounted pivotally on the maintenance apparatus 3 and whereof the pivotal drive is in controlled connection with the control apparatus 30. These pivot arms raise the bobbin arms 121 for piecing so that the bobbin 122 is separated from the bobbin drive roller 120 and can be driven by the auxiliary drive roller 311. On completion of the piecing procedure, the bobbin arms 121 are lowered again so that the bobbin 122 (timed to coincide with the point at which the pair of draw-off rollers 15 take over thread draw-off) is again driven by the bobbin drive roller 120.

To release a piecing thread reserve which is formed during preparation of the piecing procedure in the returned thread, there is provided a throw-off spindle 33 whereof the drive (not shown) is in controlled connection with the control apparatus 30 by way of a line 330.

In undisrupted spinning operation, the sliver 2 is supplied by means of the delivery apparatus 13 to the opening apparatus 14, is opened thereby in an ideal case to give individual fibres (fibres 22) and in this form is supplied to the fibre collection surface 17 of the spinning rotor 110. There, the fibres 22 are deposited briefly and are thus incorporated in known manner into the end of a thread 20 which is forming and which is drawn off from the open-end spinning apparatus 11 through the thread draw-off tube 112 with the aid of the pair of draw-off rollers 15. The thread 20 leaving the pair of draw-off rollers 15 is supplied to the bobbin apparatus 12 and wound onto the bobbin 122.

If for any reason a thread breakage occurs, the latter is recorded by the thread monitor 16 and a message is sent by way of a control connection (not shown) of the control apparatus 30 or a control unit (not shown) cooperating with the control apparatus 30 (e.g. a central control unit on the open-end spinning machine 1). At the same time, the thread monitor 16 switches off the delivery apparatus 13 in a manner known per se.

The control apparatus 30 or the control unit cooperating with the control apparatus contains a timer element (not shown) which starts to run as a result of the message of the thread breakage. If a further thread breakage occurs at another spinning point 10 while this timer element is running, then a further timer element starts to run. The running time of these timer units can be used to determine the period of time between the occurrence of one thread breakage and the start of elimination of the thread breakage.

As the maintenance apparatus 3 runs along the open-end spinning machine 1, it interrogates, by way of a line (not shown), whether the spinning point 10 which it first reaches operates in problem-free manner, or whether a thread breakage is to be eliminated at this spinning point 10. If piecing has to be carried out again at this spinning point 10 in order to eliminate a thread breakage, then the maintenance apparatus 3 stops and first carries out preparatory operations. This includes, for example, braking the spinning rotor 110, cleaning the open-end spinning apparatus 11 or parts thereof, raising the bobbin 122 away from the bobbin roller 120, locating the end of the broken thread 20 on the bobbin 122, drawing off from the bobbin 122 a thread length adequate for piecing while at the same time driving the bobbin 122 by means of the auxiliary drive roller 311, preparing the thread end, laying the thread on the throw-off spindle 33 while introducing the thread end into the thread draw-off tube 112 and accelerating the spinning rotor 110 to production speed.

These procedures are controlled from the control apparatus 30 in known manner. Once these preparatory operations are complete, actual piecing can begin.

From the point at which the maintenance apparatus 3 is stopped at the spinning point 10 until the piecing procedure is completed, all the operations are precisely fixed with respect to time, it being possible to pre-set various time sequences individually as desired, to match them to material, yarn thickness, etc.

While the delivery apparatus 13 is at a standstill, with the opening cylinder 141 continuing to run, the latter continues to comb fibres 22 out of the leading end of the stopped sliver 2, the so-called tuft 21, so that the latter becomes shorter and thinner. The longer the standstill time of the delivery apparatus 13 (with the opening apparatus 14 always continuing to run), the shorter the tuft 21 becomes, until, in the case of a long standstill time, no more fibres 22 project into the working region of the opening cylinder 141. These different states of the tuft 21 result in differing acceleration behaviour in the fibre supply.

Corresponding to the standstill times of the delivery apparatus 13 as the opening cylinder 141 continues to run and, determined thereby, the different states of the tuft 21, the thread draw-off has to be switched on, relative to the release of the tuft 2 by switching on the delivery apparatus, earlier (when the tuft ,21 is impaired to a small extent as a result of a short standstill time) or later, and has to be accelerated to a greater extent (when the tuft 21 is impaired to a small extent) or to a lesser extent. For this reason, at the start of the piecing procedure, the state of the tuft is determined (as a function of the time or otherwise) and the start and/or also the acceleration profile of the thread draw-off is matched to this state of the tuft 21 in the manner described.

Figure 5:
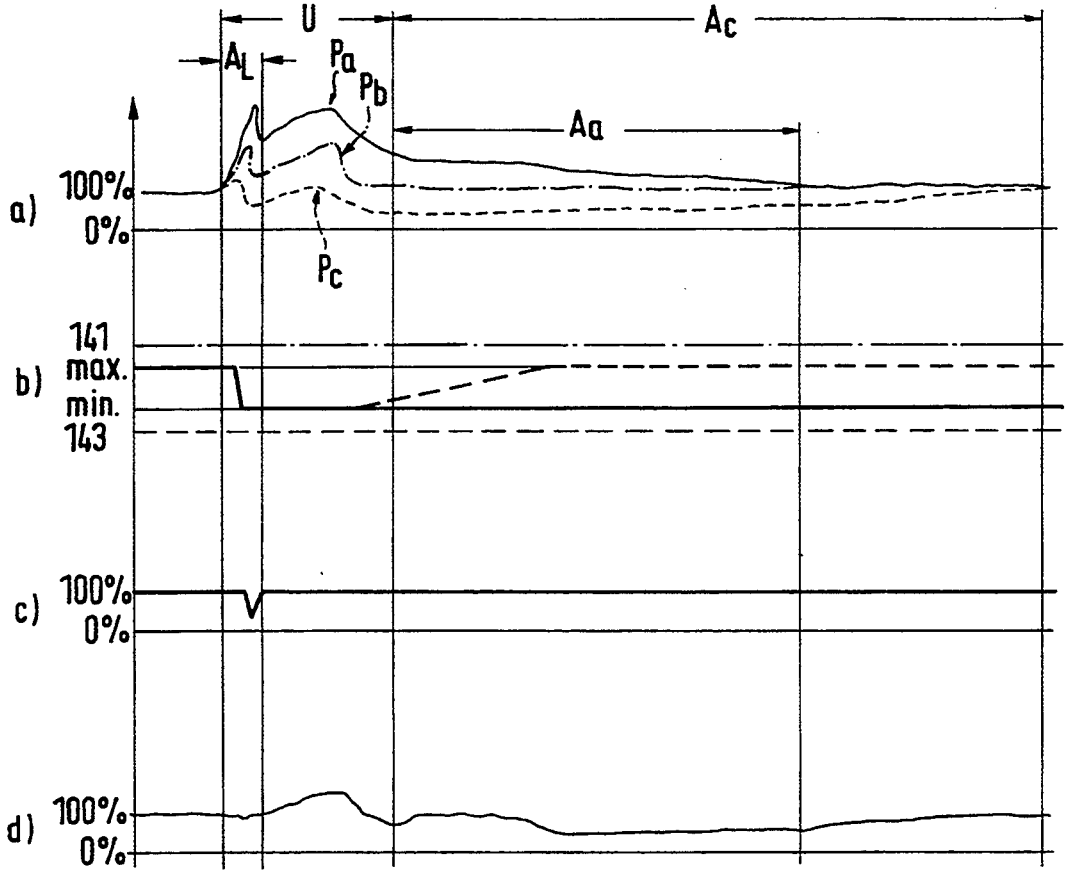
FIG. 5 is a schematic comparison view of a conventional and an inventive joint and the tuft position required for this and the flow of fibres produced thereby.

FIG. 5*a*) shows the joints $P_a$, $P_b$ and $P_c$ with standstill times of the delivery apparatus 13 of various lengths as the opening cylinder 141 continues to run and subsequent uncontrolled release of the sliver 2 by switching the delivery apparatus 13 on again. 100% indicates the normal yarn thickness.

When the delivery apparatus 13 is briefly at a standstill, relatively little fibre material is combed out of the tuft 21 by the opening cylinder 141 which continues to run, so that the fibre supply to the fibre collection surface begins rather suddenly at full intensity. The result is a very substantial joint $P_a$ which exceeds the normal thickness of the thread, not only in the overlap region of the thread end $E_G$ (see FIG. 7) and fibre ring $R_F$ (longitudinal section $A_L$), but also includes the entire length of the periphery U of the spinning rotor 110 and is adjoined by a long thread section $A_a$ of oversized thickness.

A particularly short joint $P_b$ results with an average standstill period of the delivery apparatus 13 while the opening cylinder 141 continues to run. This joint $P_b$ already has the normal thickness after the thread length corresponding to the periphery U of the spinning rotor 110.

With a very long standstill period, the tuft 21 is both combed out thoroughly and shortened. As a result of this, on the one hand, it takes longer for the sliver 2 to reach the working and effective region of the clothing 143 of the opening cylinder 141 and the fibre flow to the spinning rotor 110 (or a spinning element of other construction) to begin at all. In addition, when it finally does begin, the fibre flow is, on the other hand, at first very thin and requires a relatively long period of time until it reaches its full production value. As the joint $P_c$ shows, although the section $A_L$ is still slightly thickened in its first longitudinal region, its diameter is subsequently already reduced. Such a reduced longitudinal section is encountered not only in the longitudinal region corresponding to the peripheral region of the spinning rotor 110 but also in the thread section $A_c$ adjoining it.

Figure 6:
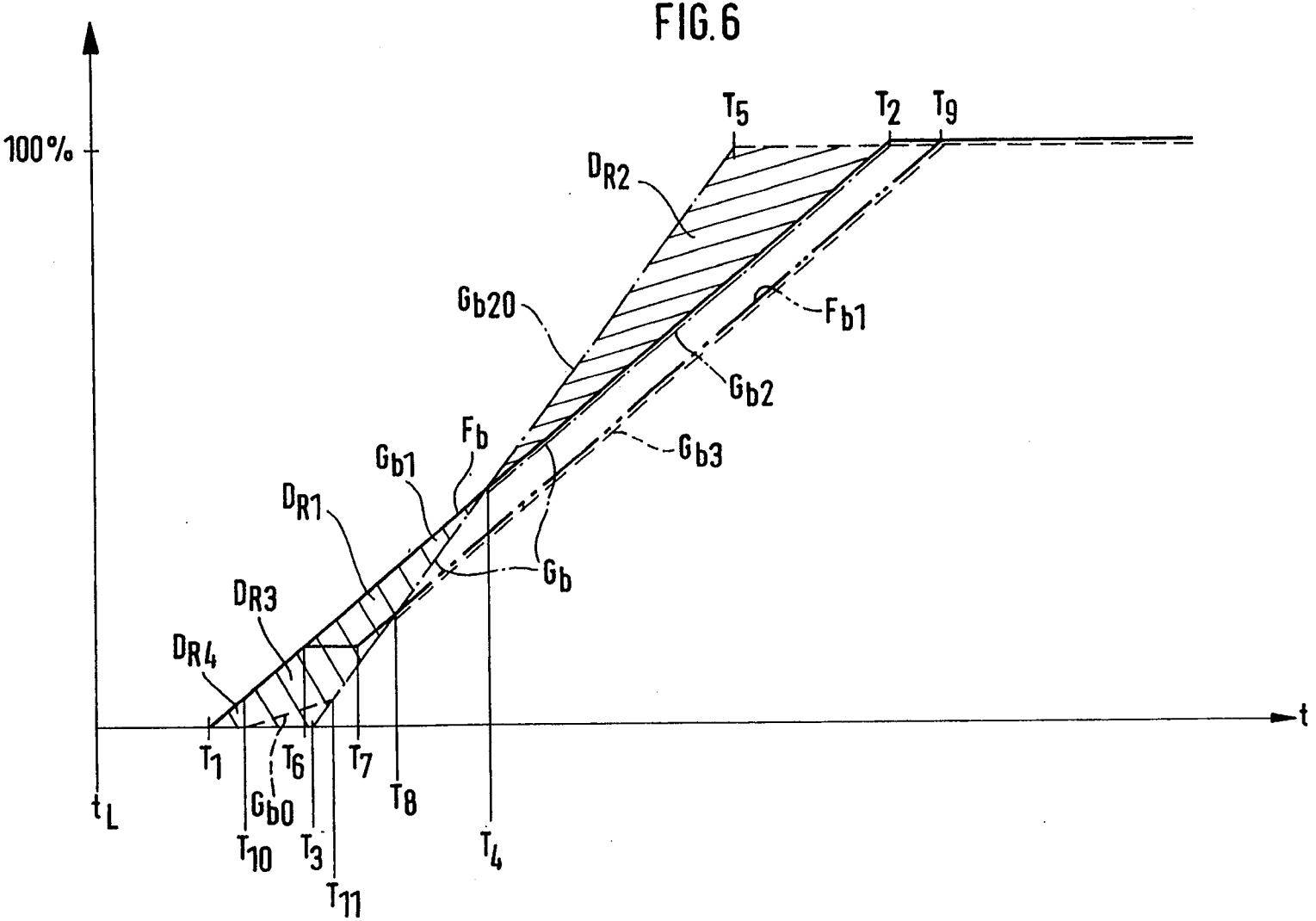
FIG. 6 is a schematic representation of the running on curves of fibre supply and thread draw-off.

With the aid of FIG. 6, and with reference to a typical example (average standstill period of the delivery apparatus 13 between response of the thread monitor 16 and switch-on point $t_L$ of the delivery apparatus 13), piecing will be explained below:

The x axis of FIG. 6 shows the time t, while the y axis gives the speed in per cent (%) of the respective production values.

When the delivery apparatus 13, which was previously stopped on the occurrence of a thread breakage, is put back in operation at the switch-on point $t_L$, the sliver 2 is again supplied to the opening apparatus 14. With a delay determined by the time required to produce a fibre flow again between the delivery apparatus 13 and the open-end spinning element, e.g. spinning rotor 110, the fibre supply to the fibre collection surface of the spinning rotor 110 starts up again (see point $T_1$). The time span within which the fibre flow (relative to the fibre collection surface) reaches its full value again also depends on the standstill period of the delivery apparatus 13 while the opening cylinder 141 continues to run. The time span is characterized in FIG. 6 by the point $T_1$ for the start of the fibre flow and $T_2$ for reaching the full fibre flow (100%, relative to the fibre collection surface).

FIG. 6 shows in a diagrammatic way the natural acceleration curve of the fibre supply $F_b$ as it is effective at the fibre collection surface. This acceleration curve is produced on switching on the delivery apparatus 13 when there is no external intervention in the drive of the delivery apparatus 13 but when the latter is connected to a drive running at the production speed only by switching on, or when the delivery apparatus running at production speed is brought back into effect, where this drive is previously not interrupted but brought out of operation merely by lifting the feed trough 131 from the delivery roller 130. This natural acceleration curve is formed as a function of the combing state and thus varies accordingly.

Thread draw-off $G_b$ is matched to the state of the tuft 21. Here, as far as possible, the draw-off acceleration is chosen such that the thread draw-off $G_b$ reaches its production value (100%) substantially at the same time as fibre supply $F_b$. In this connection, the thread 20 (with a slight impairment of the tuft 21) is, with a short delay (see point $T_3$) with respect to release of the sliver 2 (see switch-on point $t_L$), quickly brought to the same percentage speed value as the fibre supply $F_b$ (see acceleration phase $G_{b1}$ and point $T_4$) in order then to accelerate in synchronism therewith (see acceleration phase $G_{b2}$). The transitions are smooth, although this has not been taken into account in FIG. 6 for the sake of simplifying the illustration.

For the sake of clarity, in FIG. 6 the reproduction of the thread return delivery has been omitted. It takes place after switching on the delivery apparatus 13 at a point such that, following a desired or indeed an unavoidable dwell period at the fibre collection surface, thread draw-off Gb can take place in the manner shown.

When the fibre supply to the fibre collection surface starts up, before thread draw-off $G_b$ begins, there is formed at the fibre collection surface an accumulation of fibres which takes on the form of a fibre ring in the case of the spinning rotor 110 chosen as an example. This results in a thick point $D_1$ (see FIG. 7) in the joint and, in FIG. 6, this is manifested as the triangle $DR_1$ determined by the points $T_1$, $T_4$ and $T_3$. The larger the interval between the points $T_1$ and $T_3$ and the flatter the acceleration curve of thread draw-off in the acceleration phase $G_{b1}$, the larger this fibre accumulation bringing about this thick point.

In FIG. 6, in addition to the acceleration phases $G_{b1}$ and $G_{b2}$, an acceleration phase $G_{b20}$ is also indicated in dot-and-dashed lines, and this is produced when the acceleration of thread draw-off $G_b$ remains unchanged until the production draw-off speed is reached (point $T_5$) (100%). Then, thread draw-off $G_b$ from the point $T_4$ till the point $T_2$ is faster by a percentage than the fibre supply $F_b$ to the fibre collection surface, so that a thin point $D_2$ is produced in the thread 20 (see FIG. 7), as is manifested by the triangle $DR_2$ determined by the points $T_4$, $T_5$ and $T_2$.

Figure 11:
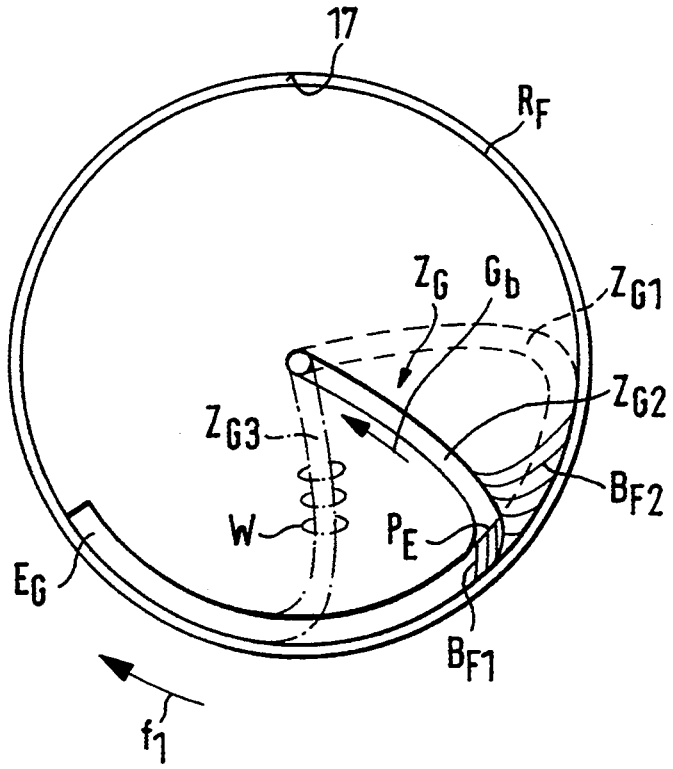
FIG. 11 is a plan view of the fibre collection surface of a spinning rotor having a fibre ring and, deposited thereon, a thread end, during the piecing phase, in schematic representation.

Before the joiner produced with the acceleration curve of fibre supply $F_b$ and thread draw-off $G_b$ is described in more detail, there will be described with the aid of FIG. 11 what happens when the fibre ring $R_F$ which has formed on the fibre collection surface 17 of the spinning element constructed as a spinning rotor 110 is broken up.

The time difference ($T_3$-$T_1$) (FIG. 6) indicates how much later the thread draw-off $G_b$ begins after the fibre supply $F_b$. The greater this time difference, the larger the fibre ring $R_F$ constructed in the spinning rotor 110 is too, whereas the smaller this time difference, the smaller the fibre ring $R_F$.

It is assumed that a thread breakage is to be eliminated. After the usual preparations (cleaning the spinning rotor 110, locating the thread end $E_G$ on the bobbin 122 (FIG. 1), trimming and preparing the thread end, releasing the previously stopped spinning rotor 110, etc.), the fibre supply $F_b$ (point $T_1$) is released and then accelerates to its production value (100%) and forms a fibre ring $R_F$ in the spinning rotor 110. Matched to this acceleration of the fibre supply to the fibre collection surface, the thread end $E_G$ is returned to the fibre collection surface of the spinning rotor 110, with the thread end $E_G$ being deposited in the direction of rotation of the spinning rotor 110 (see arrow $f_1$) over part of the periphery U of the fibre collection surface 17 (see also FIG. 7), its radial intermediate region $Z_G$ adopting the position $Z_{G1}$.

After a brief dwell time at the fibre collection surface, the thread end $E_G$ undergoes thread draw-off $G_b$, which also accelerates to its production value (100%). Here, the thread end $E_G$ is tensioned, and its intermediate region $Z_G$ reaches the position $Z_{G2}$. Here, the thread end $E_G$ pulls on the fibre ring $R_F$ so that, as seen in the peripheral direction of the fibre collection surface 17, fibres extend on both sides of the incorporation point $P_E$ from the thread end $E_G$ to the fibre ring $R_F$ and form fibre bridges $B_{F1}$ and $B_{F2}$. As thread draw-off $G_b$ continues, the intermediate region $Z_G$ of the thread end $E_G$ reaches the position $Z_{G3}$. The fibre bridges $B_{F1}$ and $B_{F2}$ tear and wind themselves around the thread end $E_G$ in the form of random windings W. The size of this fibre bridge $B_{F2}$ and thus the size of the accumulation of windings W here depends substantially on the rotor diameter and the length of the processed fibres.

Figure 7:
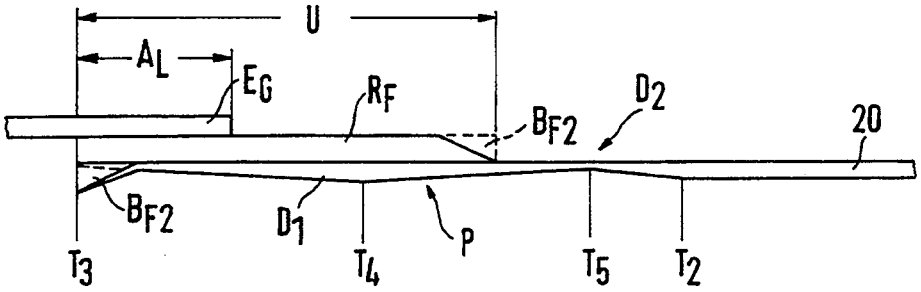
FIG. 7 is a schematic representation of a joint produced in accordance with the process according to FIG. 6 and the adjoining thread piece.

A joint P produced by the process according to FIG. 6 has the appearance shown diagrammatically in FIG. 7 (cf. joint $P_c$ in FIG. 5*a*)). The thread end $E_G$ returned to the spinning rotor 110 at the fibre collection surface thereof is deposited over a part region of the periphery U of the fibre collection surface 17 (FIG. 11) after a partial fibre ring has already formed in the spinning rotor 110 (FIG. 1). Until thread draw-off $G_b$ begins, further fibres 22 are deposited in the spinning rotor 110 and form, with the fibres 22 fed to the spinning rotor 110 before thread return delivery, a fibre ring $R_F$ (see FIG. 5*b*): 100% until section $A_L$. Here, the quantity of fibres corresponds to the triangle $DR_3$ shown in FIG. 6 between points $T_1$ and $T_3$.

When thread draw-off $G_b$ starts up, the fibre ring $R_F$ is torn open, with not only those fibres which are on the side facing the free end of the thread end $E_G$ relative to the incorporation point $P_E$ (arrow $f_1$—fibre bridge $B_{F1}$), but also those fibres from the other side of the incorporation point $P_E$ (fibre bridge $B_{F2}$), being incorporated into the thread end $E_G$. These fibre bridges $B_{F1}$ and $B_{F2}$ thus reach the point of the joint P at which the fibre ring $R_F$ is burst open in the form of random windings W (left-hand side of FIG. 7). The joint P thus starts at point $T_3$ with a very pronounced jump in cross-section.

In this first longitudinal section $A_L$ of the joint P, the returned thread end $E_G$ and the fibre ring $R_F$ overlap. Moreover, this longitudinal section has the random windings W and is, therefore, particularly thick. The longitudinal section of the thread corresponding to the periphery U of the spinning rotor 110 is still of an oversized thickness but is not quite so thick as the longitudinal section $A_L$ with the random windings W. Depending on the duration of the standstill period of the delivery apparatus 13 before piecing with the opening cylinder 141 still running, the said further longitudinal section $A_a$ and $A_c$ (see FIG. 5*a*)), which has a thickness deviating from that of a normal thread, adjoins the longitudinal section corresponding to the periphery U, with it being possible for this longitudinal section $A_a$ or $A_c$ to be thicker or indeed thinner than the normal thread.

With a thread draw-off $G_{b1}$, $G_{b20}$ according to FIG. 6, the fibre supply $F_b$ only reaches its full production value (100%) at the point $T_2$, that is to say later than the point $T_5$ at which thread draw-off $G_b$ has already reached its full production value (100%). The thick point $D_1$ produced during this grows from the point $T_3$ to the point $T_4$, since during this time thread draw-off $G_b$ is still smaller by a percentage than the fibre supply $F_b$, and then lessens again, since the fibre supply $F_b$ is then smaller than thread draw-off $G_b$. Adjoining this thick point $D_1$, starting from the moment at which the fibre ring $R_F$ has been completely incorporated into the joiner P, in the longitudinal section $A_c$ (see FIG. 5*a*)), is a thin point $D_2$ which reaches its thinnest point at the point $T_5$ and ends at the point $T_2$.

The thick point formed by the windings W (fibre bridge $B_{F2}$) in the joint P can be reduced by a relatively brief pre-feed, that is to say by a relatively thin fibre ring $R_F$. Then, however, the thick point $D_1$ still remains. If thread draw-off $G_b$ is increased, then on the one hand a very high draw-off tension is formed and with it the risk of thread breakage. Moreover, the longitudinal section $A_L$ formed by the overlap of the thread end $E_G$ and the newly supplied fibres becomes too thin, which again leads to thread breakage.

In order to prevent this thick point $D_1$ and yet to have available sufficient fibres for piecing, in accordance with FIG. 6, after the fibre ring $R_F$ has substantially reached the desired thickness, the fibre flow, which is still growing, is temporarily kept constant for a short time or is even reduced suddenly in order to achieve a synchronous acceleration of the fibre supply $F_b$ and the thread draw-off $G_b$ as quickly as possible. This reduction in the fibre flow should be carried out as suddenly as possible, that is to say almost immediately, and thus as quickly as is at all possible, since the effect is the more intensive the quicker the reduction in the penetration depth of the tuft 21 into the clothing 143 of the opening cylinder 141 and thus the reduction of the fibre flow. If, on the other hand, the alteration in the penetration depth is effected slowly, then it has virtually no effect on the fibre flow. The thread thickness cannot then be influenced, but in this way the tuft 21 can be brought to a desired starting position or to the production position without altering the thread thickness.

For example, at the point $T_6$, a further increase in the fibre flow is prevented and is only permitted again from the point $T_7$ onwards.

In the embodiment shown, the thread draw-off $G_b$ and the fibre supply $F_b$ have, from the point $T_8$, reached the same percentage value as regards their production value, and from then on accelerate in synchronism (see fibre supply $F_{b1}$ and thread draw-off $G_{b3}$) until they simultaneously reach their respective production values at the point $T_9$. The synchronous acceleration of the fibre supply $F_{b1}$ and thread draw-off $G_{b3}$ is achieved in that the thread draw-off $G_{b3}$, matched to the fibre supply, is controlled such that it is matched to the running-on, reduced by the reduction in the penetration depth of the tuft 21, of the fibre supply $F_{b1}$ at the fibre collection surface 17.

As already described above, it is not sufficient to match the thread draw-off alone to the reduction in the penetration depth of the tuft, but in this connection it is also necessary to take into account the state of the tuft 21 as well. This is achieved most easily in that the tuft 21 is at least approximately in a state of equilibrium between the fibres 22 combed out per unit of time on the one hand, and the fibres 22 supplied with the sliver on the other hand, directly before it is returned from its position with an increased penetration depth into the clothing 143 of the opening cylinder into its position of reduced penetration depth. This means that if the quantity of fibres combed out per unit of time is still increasing, as a result of the impaired state of the tuft 21, at the moment at which the tuft is returned, then depending on the order of magnitude of this rate of increase the effect of the alteration in position can be suspended again or at least reduced, depending on the rate of alteration in position.

However, the time from the response of the thread monitor 16 until the start of the piecing procedure can also serve to determine the state of the tuft at the time of piecing, since the degree of impairment of the tuft is dependent on this time, that is to say the standstill time of the feed apparatus 13 while the opening cylinder 141 continues to run.

If appropriate, however, the state of the tuft 21 may also be determined by a direct optical or pneumatic measurement.

In order to reduce the draw-off acceleration in the first phase of thread draw-off, since the fibres collected in the spinning rotor 110 cannot yet result in sufficient strength in the joint P, and in order to counter the thick point created by the fibre bridge $B_{F2}$, then in accordance with a variant shown in FIG. 6, it is provided that the thread draw-off (acceleration phase $G_{b0}$), after the start (point $T_1$) of the fibre supply $F_b$ to the fibre collection surface 17 (FIG. 11) but before the conventional start of draw-off (point $T_3$), begins at a very low acceleration (point $T_{10}$), and after a short period goes over to the acceleration phase $G_{b1}$ (point $T_{11}$). The triangle $DR_4$ produced between the points $T_1$ and $T_{10}$ is very small, which means that only a very thin fibre ring has formed before the start of thread draw-off. However, as a result of the initial acceleration of the thread draw-off, sufficient fibres 22 may be deposited at the thread end $E_G$ being drawn off for secure piecing to be ensured.

Figure 12:
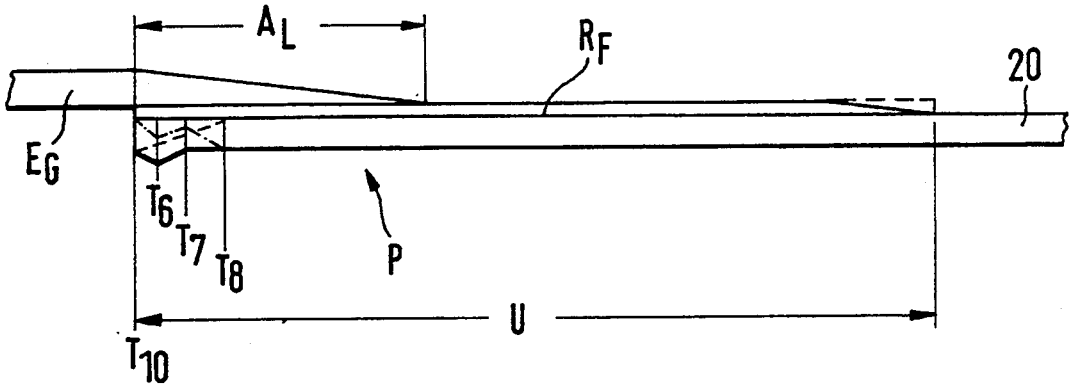
FIG. 12 is a schematic representation of another modified joint according to the present invention.

If, in addition, the increase in the fibre supply $F_b$ between the points $T_6$ and $T_7$ is temporarily kept constant or is even reduced, then a joint P of this type is definitely unobtrusive if the thread end $E_G$ is tapered before returning and has a substantially wedge-shaped form (FIG. 12).

In accordance with FIGS. 5*b*) to 5*d*), the thick point formed by the thread breakages $B_{F2}$ (see FIG. 11) is compensated. To this end, the leading end of the sliver 2, forming a tuft 21, is first supplied to the opening cylinder 141 for piecing at a penetration depth which is greater than the penetration depth after piecing. The transition from the greater to the lower penetration depth is effected such that it is matched to the release of the sliver, with the, piecing procedure for its part being matched to the alteration in penetration depth.

In accordance with FIGS. 5*b*), 5*c*), the fibre supply $F_b$ to the fibre collection surface of the spinning rotor 110 is substantially reduced at the point at which the fibres 22 which later form the first longitudinal section $A_L$ are temporarily left only to a reduced extent on the fibre collection surface (see FIGS. 5*b*) and 5*c*)). FIG. 5*b*) indicates by the dot-and-dashed line the periphery of the opening cylinder 141 and by the dashed line the working circle of the clothing 143 of the opening cylinder. "max" shows the maximum and "min" shows the minimum penetration depth of the tuft 21 into the clothing 143 of the opening cylinder 141. As shown, the penetration depth of the tuft 21 before piecing is particularly high (max), while it is reduced at the desired point during piecing (min). During this alteration, that is to say reduction of the penetration depth of the tuft 21 into the clothing 143 of the opening cylinder 141, the fibre flow $F_b$ to the fibre collection surface is briefly reduced in order immediately thereafter to return to its normal value (see FIG. 5*c*)).

As a comparison between FIG. 5*a*) (joint $P_b$) and FIG. 5*d*) shows, the thick point which is otherwise unavoidable in the longitudinal region $A_L$ has disappeared. This can be attributed to the fact that the fibre supply to the fibre collection surface 17 begins at the point at which the penetration depth of the tuft 21 into the clothing 143 of the opening cylinder 141 is reduced.

In the embodiment shown in FIG. 5*d*), only the thick point in the adjoining region of the thread section corresponding to the periphery U of the spinning rotor 110 is still included in the newly spun thread.

By controlling the timing of the penetration depth alteration, one or the other thick point can selectively be completely or at least largely compensated. If a plurality of penetration depth alteration apparatus 4 are provided, as is described below with the aid of FIG. 1, then a plurality of thick points can also be eliminated.

Now that the effect sought and the process to be carried out therefor have been described, a penetration depth alteration apparatus 4 for the tuft 21 for carrying out the process described will now be explained with the aid of FIG. 1. This penetration depth alteration apparatus 4 is formed by the underpressure source 32, the underpressure line 18 and the switching apparatus, in the form of a control valve 181, in the underpressure line 18, with the switching valve 181 being in controlled connection with the control apparatus 30.

During the preparatory operations for piecing, after cleaning the spinning element, for example the spinning rotor 110, the spinning underpressure is switched off by closing the switching apparatus 115. The suction air flow generated by the underpressure source 32 is brought into effect by opening the switching apparatus 181, which can take place shortly before or simultaneously with or indeed shortly after switching off the spinning underpressure. Because of the underpressure which is effective in the open-end spinning apparatus 11 in the thread draw-off tube 112, the thread which is correspondingly released by the bobbin 122 in a known manner, is introduced in conventional manner into the thread draw-off tube 112, without however the fibre collection surface of the spinning rotor 110 or spinning element of other construction being touched.

Opening the switching apparatus 181 prevents further fibres 22 from being able to reach the fibre collection surface after cleaning the spinning element on switching the feed apparatus 13 on again. After opening the switching apparatus 181, the feed apparatus 13 is switched on again. The fibre flow is now sucked through the suction-air opening 180 out of the housing 140. Since the spinning underpressure is switched off at the housing 113 of the open-end spinning apparatus 11, the suction air flow which has been brought into operation at the suction-air opening 180 is sufficient for the fibres 22 to pass over the mouth 117 of the fibre feed channel 111 into the suction-air opening 180. In this manner, it is ensured that the fibres 22 which, during the time from the switch-off phase of the delivery apparatus 13, were impaired by the opening cylinder 141, which continues to run, do not reach the spinning rotor 110.

As a result of throw-off by the throw-off spindle 33, the thread which has previously been prepared in a conventional manner for piecing is returned to the fibre collection surface as a result of the underpressure (underpressure source 32) applied at the housing 140 and effective by way of the fibre feed channel 111 also in the spinning rotor 110. Timed to this, the switching apparatus 181 is closed and the switching apparatus 115 is opened, so that the stronger underpressure source 32 becomes ineffective by being switched off, while the weaker underpressure source 116 effecting the spinning underpressure and present at the fibre collection surface 17 is brought back into effect by being switched on. As a result of this switching over of the underpressure, the fibres 22 now suddenly reach the spinning rotor 110. As a result of the establishing of contact, effected thereby, between the thread end $E_G$ and the fibres 22, the fibres 22 deposited on the fibre collection surface 17 are incorporated into the thread end $E_G$. The thread is then drawn off out of the spinning rotor 110—with constant incorporation of the continuously supplied fibres 22—and wound onto the bobbin 122.

The underpressure effect acting on the tuft 21 is kept, until the penetration depth of the tuft 21 into the clothing of the opening cylinder 141 is reduced, at a level which ensures the increased penetration depth and which is acceptably higher than that required for spinning, in order that a perceptible alteration in the penetration depth of the tuft 21 and thus of the fibre flow is achieved. To this end, the underpressure conditions of the air flows generated by the underpressure sources 32 and 116 are chosen such that the underpressure source 32 produces a substantially greater underpressure than the underpressure source 116.

While the underpressure source 32 is active, the tuft 21 is drawn well into the clothing 143 of the opening cylinder 141 as a result of the high degree of underpressure. Thereafter, for the duration of the time when the underpressure source 32 is switched on, the penetration depth of the tuft 21 into the clothing 143 of the opening cylinder 141 remains constant. If there is a switchover from the great underpressure of the underpressure source 32 to the lower underpressure of the underpressure source 116, then as a result of the sudden reduction in the underpressure effect the tuft 21 is raised somewhat out of the clothing 143 of the opening cylinder 141, as a result of which the fibre flow is temporarily reduced somewhat for the duration of the pivotal movement of the tuft 21 out of the deeper into the shallower penetration depth. As a result of this, fewer fibres 22 temporarily reach the spinning rotor 110 during formation of the joint, as a result of which the inevitable thickening of the thread 20 in the region of the joint P is perceptibly reduced. Depending on the intensity and speed of the alteration of the underpressure, by altering the penetration depth of the tuft 21 into the clothing 143 of the opening cylinder 141, thread thickness reductions of at least 10%, in some circumstances even up to 30%, can be achieved, so that yarn thickness fluctuations of over 10%, in some cases even up to 30%, can be compensated.

As a result of the continuous advance of the sliver 2, the penetration depth of the tuft 21 is increased again slowly until it reaches the normal spinning value, so that the normal operating fibre flow to the fibre collection surface is then achieved again. The time taken until the operating fibre feed has been reached again depends on the speed at which the sliver 2 is advanced.

The reduced penetration depth of the tuft 21 into the clothing 143 of the opening cylinder 141 is now maintained for production so that no further alterations in the underpressure effective in the housing 140 of the opening cylinder 141 are required.

In principle, an alteration in the penetration depth of the tuft 21 into the clothing 143 of the opening cylinder 141, in the manner of an increase or in the manner of a reduction in the penetration depth, is possible. The penetration depth alteration apparatus 4 described above, which is formed by the underpressure source 32 with the associated underpressure line 18 and the switching valve 181, is a penetration depth increase apparatus, since it operates in the manner of an increase in the penetration depth. As will be described below, a construction of a (modified) penetration depth alteration apparatus 4 as a penetration depth reduction apparatus is also possible.

Switching off of the underpressure at the line 18 or the mouth 180 is controlled to be timed such that the sudden slight lifting of the tuft 21 out of the clothing of the opening cylinder 141 coincides in time with piecing. This results in a thick point compensation.

Figure 8:
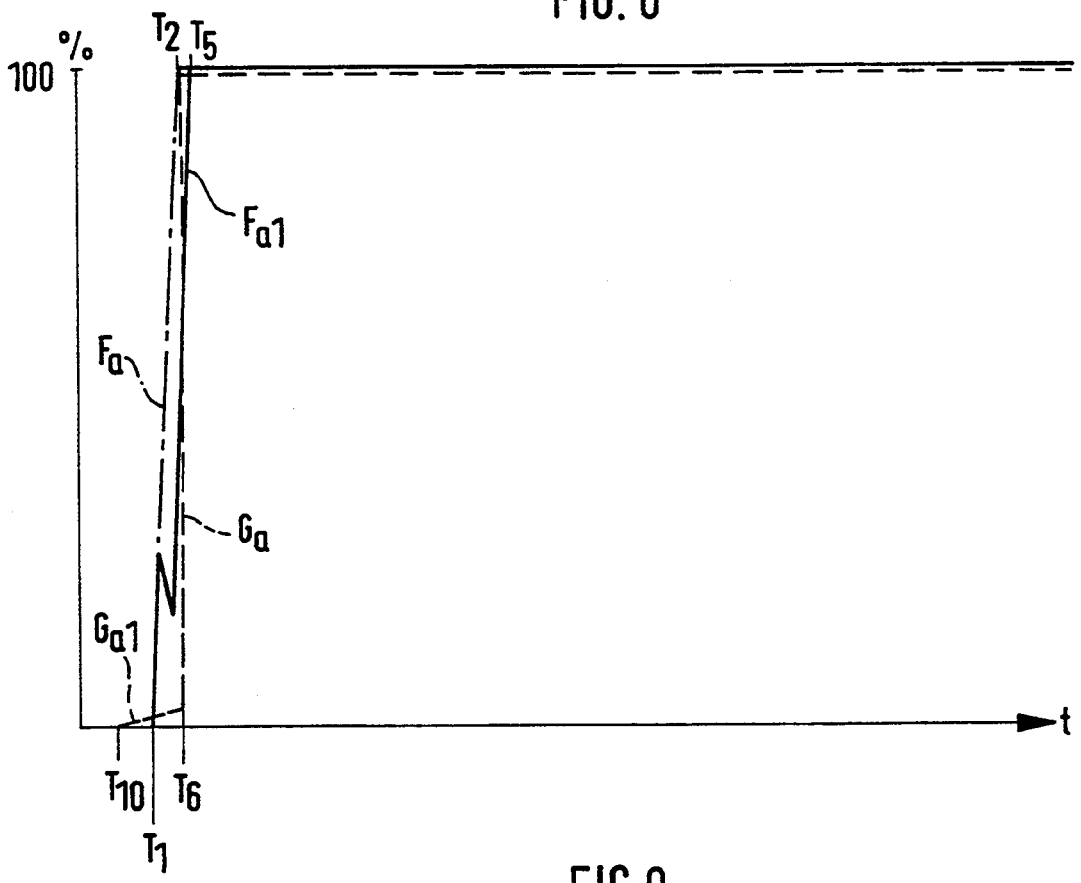
FIG. 8 is a graph of a modified form of fibre supply and thread draw-off.

In the event of a rapid increase in the fibre flow from the underpressure line 18 into the spinning rotor 110, the thread 20 is, in accordance with FIG. 8, on completion of the first phase $G_{a1}$ of draw-off $G_a$, suddenly subjected to the clamping action of the driven pair of draw-off rollers 15, which, in the second piecing phase, suddenly brings the thread 20 to the draw-off speed (100%) effective during production. Any thread excess which may arise here is compensated by the formation of a thread reserve or a greater acceleration of the bobbin 122.

By way of example, the thread 20 reaches the line of clamping of the pair of draw-off rollers 15 in a manner known per se as early as during thread return, the draw-off roller 151 (pressure roller) of this pair of draw-off rollers 15 first being raised away from the driven draw-off roller 150 and, for the start of thread draw-off $G_a$, being placed back on the driven draw-off roller 150 at the desired point ($T_6$) and thus effecting the sudden acceleration of draw-off, while draw-off in the first phase $G_{a1}$ is effected with the aid of the bobbin 122.

As FIG. 8 shows, the phase $G_{a1}$ of thread draw-off $G_a$ can already begin before the deflection of the fibre flow is complete and fibre supply $F_a$ to the fibre collection surface has started up (point $T_{10}$), by means of which, because of the reduced underpressure effective after the switchover, the penetration depth of the tuft 21 into the clothing 143 of the opening cylinder 141 is also suddenly reduced. Thus, thread draw-off $G_a$ already begins with the phase $G_{a1}$, before the penetration depth is reduced.

Figure 9:
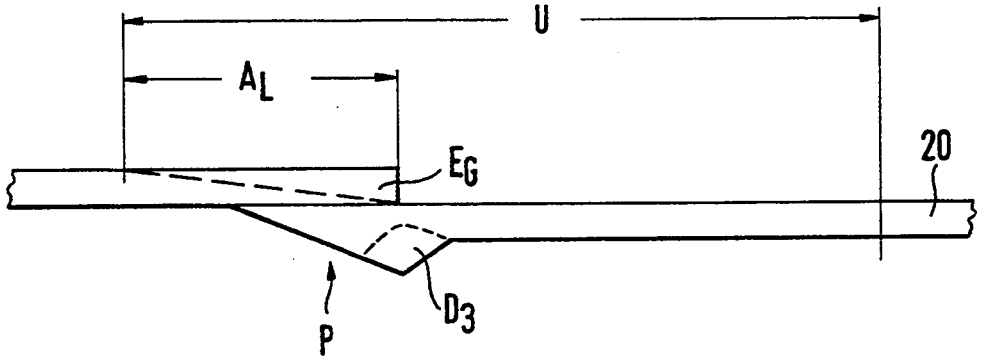
FIG. 9 is a schematic representation of the joint produced according to the process according to FIG. 8, and the thread piece adjoining it.

Before the thread end $E_a$ leaves the fibre collection surface 17, fibres 22 reach it, however, and the fibre supply $F_a$ is now increased very rapidly. As a result of this rapid increase in the fibre supply $F_a$ (between points $T_1$ and $T_2$), the joint P still has in its longitudinal section $A_L$ an adequately large mass of fibres also to guarantee the required strength. As FIG. 9 shows, the joint P is not only very short but even ends before the fibres deposited on the entire periphery U of the fibre collection surface have been spun into the new thread.

Here too, there is in the joint P a small thick point $D_3$ which depends substantially on the shape of the returned thread end $E_G$ but which cannot conventionally be completely avoided, even with a thread end $E_G$ which has been prepared in an optimum manner. However, if the penetration depth alteration apparatus 4 is appropriately controlled, so that in conjunction with these switching procedures the tuft is raised somewhat out of the clothing 143, then the thick point $D_3$ can be compensated here too (see fibre supply $F_{a1}$). To this end, an appropriate dimensioning of the underpressures in the underpressure lines 114 and 18 is necessary.

Figure 3:
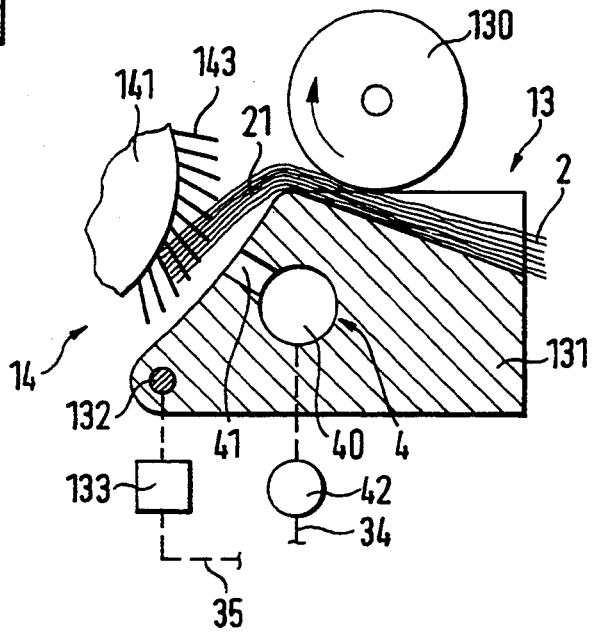
FIG. 3 is a side view of the apparatus shown in FIG. 2, pressing the tuft into the clothing of the opening cylinder with a reduced penetration depth.

The penetration depth of the tuft 21 into the clothing 143 may also be reduced in another manner. A further possibility for this is illustrated in FIGS. 1 to 3.

In principle, the underpressure for altering the penetration depth of the tuft 21 into the clothing 143 of the opening cylinder 141 may also be increased at the fibre collection surface 17. Since, however, at the same time the suction effect acting on the thread end $E_G$ prepared for the piecing return is also increased, which leads to an impairment of the thread end EG, it is better to bring the increased underpressure into effect, as described, at a point lying downstream of the supply point of the tuft 21 to the opening cylinder (feed apparatus 13) at which the fibres 22 have not yet reached the fibre collection surface 17. This then also makes possible a solution as described above and, in accordance with which the fibres 22 are guided away until the penetration depth of the tuft 21 into the clothing 143 of the opening cylinder 141 is reduced without previously having reached the fibre collection surface 17, and are substantially, then only, supplied to the fibre collection 17 once the penetration depth is reduced. Depending upon the effect sought, relatively small time offsets are possible.

The alteration of the underpressure acting in the housing 140 for the opening cylinder 141 does not need to be effected by switching between two underpressure sources (32 and 116). Rather, in some circumstances it may also be provided for the underpressure source 116 not to be controlled and to remain effective constantly, while the underpressure source 32 is temporarily additionally brought into effect.

The penetration depth alteration apparatus 4 is thus formed by the two underpressure sources 116 and 32 jointly as essential constituents, with the increased penetration depth of the tuft 21 into the clothing 143 of the opening cylinder 141 being achieved by the simultaneous effect of both underpressure sources 32 and 116. Here, it can be provided that in order to guide away the fibres 22 already released by the delivery apparatus 13 for piecing, first only the underpressure source 32 is switched on, then, in order to achieve the increased tuft penetration depth, the underpressure source 116 is additionally switched on so that both underpressure sources 116 and 32 operate in overlapping manner until the underpressure source is ineffective to reduce the penetration depth.

In principle, the increased underpressure may be controlled by switching the underpressure source 32 on and off. However, this is not very favourable, since the underpressure builds up relatively slowly in the underpressure line 18. For this reason, it is better, as shown in FIG. 1, if there is in the underpressure line 18 a switching valve 181 which separates the already operating underpressure source 32 from the suction-air opening 180, or connects it thereto.

Although, in principle, the air flow desired for altering the tuft penetration depth may thus be switched on by switching on the underpressure source 32, this is best effected by opening the switching valve 181. Analogously, the air flow is then switched off by closing the switching valve 181.

In accordance with the first variant which is shown in FIGS. 1 and 2 and which can be applied as an addition or an alternative to the previously described embodiment, an underpressure is brought into effect, just as in the embodiment described above, downstream of the tuft supply region to the opening cylinder 141, exceeding the underpressure effective after piecing. However, in accordance with the example to be described now, this is effected in that the penetration depth alteration apparatus 4 is provided in or at the feed trough 131 and has a compressed-air channel 40 opening in the feed trough 131 and thus in the longitudinal region of the tuft 21, an outlet opening 41 connected to the compressed-air channel 40 and opposite the clothing of the opening cylinder 141 and aligned radially with respect thereto, and an overpressure source (compressed-air source 42) acting in controlled manner on the compressed-air channel 40 with air pressure. The compressed-air source 42—as indicated by a dashed line 34—is controlled by the control apparatus 30 such that a compressed-air flow is selectively generated in the compressed-air channel 40 or is switched off.

When the air flow is switched on, there emerges from the exit opening 41 an air jet which causes the tuft 21 to penetrate deeper into the clothing 143 of the opening cylinder 141 (FIG. 3). If the air jet is switched off, then the tuft 21 is raised out of the clothing 143 somewhat (see FIG. 2), and, during the movement of this raising out, correspondingly fewer fibres 22 are delivered to the fibre collection surface 17 of the spinning rotor 110.

The control apparatus 30 (FIG. 1) controls the switching off of the compressed-air source 42 which is at first switched on so that it is switched off directly before the formation of the joint in such a way that the fibres which are briefly delivered in smaller numbers after the slight moving out of tuft 21 of the clothing 143 reach the fibre collection surface 17 at precisely the moment at which the joint P is formed. As a result of this, formation of a thick point in the region of the joint P is countered.

If, for example in order to compensate for a thin point $D_2$ (FIG. 7) following a thick point, more fibres 22 are required briefly, then the compressed-air source 42 can also be switched on again suddenly at a suitable point. In order to obtain normal operation, the penetration depth of the tuft 21 into the clothing 143 of the opening cylinder 141 must, after piecing, be brought back to the initial value at the point when the penetration depth alteration apparatus 4 operating with compressed air had not yet been switched on. This reduced penetration depth is then maintained for production. In order to achieve this, the air flow delivered by the compressed-air source 42 is continuously reduced to zero so slowly that virtually no alteration in the quantity of fibres supplied occurs during this time.

As described, if for reasons of the construction and function of the penetration depth alteration apparatus 4 its effect has to be returned to the initial basis for the transition to production conditions, it is possible, by selecting an appropriate return speed, either to moderate a thin point (see FIG. 5*d*)) or, if no thin point is to be compensated for, to return the tuft 21 to the production position so slowly that no perceptible influence on the fibre flow is brought about and thus a constant thread thickness is maintained.

Naturally, in an analogous way it is also possible, instead of the compressed-air source 42, to construct the penetration depth alteration apparatus 4 as a suction-air apparatus and to attach it to an underpressure source, e.g. the underpressure source 32, in which case a switching apparatus (not shown) for controlling the underpressure can be or is arranged between the outlet opening 41—which then of course forms a suction-air opening—and the underpressure source. In this case, the penetration depth alteration apparatus 4 forms a penetration depth reducing apparatus.

In order to keep fibre loss as low as possible, it is advantageous if the suction-air opening 41 is covered by a screen.

The penetration depth alteration apparatus 4 shown in FIGS. 1 to 3, but at an underpressure source rather than at a compressed-air source 42, can also be modified in a particularly simple way to establish the state of the tuft 21. To this end, it is merely necessary to assign a pressure gauge (not shown) to the (outlet) opening 41 forming a suction-air opening. To establish the state of the tuft 21, before the feed apparatus 13 has yet been released, underpressure is then applied at the opening 41, and the pressure drop occurring as a result of air being sucked out through the tuft 21 above the opening 41 into the opening 41 is measured with the aid of the pressure gauge. The amount of the pressure drop is directly proportional to the density of the tuft 21 and thus enables a conclusion to be drawn about the state of the tuft 21.

Before piecing, the tuft 21 is subjected to the conventional spinning underpressure so that it is subjected to the action of the opening cylinder 141 at the same penetration depth as during normal production. In order, when the delivery apparatus 13 is switched on again, to raise the tuft 21 out of the clothing 143 of the opening cylinder 141 somewhat once the tuft is released for piecing, the penetration depth alteration apparatus 4 is activated in that the underpressure source assigned to this apparatus (e.g. underpressure source 32) is brought into effect by switching on or releasing by means of a switching apparatus which is not shown (analogous to the switching valve 181). Timed to this, the piecing procedure is carried out by returning the thread end $E_G$ to the fibre collection surface 17 and drawing off the thread end $E_G$ again.

Since the penetration depth alteration apparatus 4 is not to be effected during the normal spinning procedure, that is to say in production conditions, for reasons of economy, the air flow generation apparatus 4 is made ineffective again after the piecing procedure. If a thin point is to be compensated as a result of this (see thin point $D_2$ in FIG. 7), then this switching-off procedure is effected relatively quickly, so that the tuft movement created thereby brings about a perceptible influence in the fibre flow.

If no such thin point is to be compensated for, then the penetration depth alteration apparatus 4 is made ineffective slowly in that the underpressure decrease is controlled so gradually that the fibre flow is not perceptibly influenced. As a result of this, after the rapid reduction in the penetration depth of the tuft 21 into the clothing 143 of the opening cylinder 141, brought about to influence the thread thickness, when the fibre supply has reached its full value (100%) again, the penetration depth of the tuft 21 is altered so slowly that the quantity of fibres combed out by the opening cylinder 141 per unit of time is virtually unaltered during this.

Just as the penetration depth alteration apparatus 4 is made completely ineffective, the maintenance apparatus 3, if the latter controls the penetration depth alteration apparatus 4, can leave the open-end spinning apparatus 11 at which the piecing procedure has been carried out.

The penetration depth of the tuft 21 is controlled in accordance with the embodiments described hitherto in that the tuft 21 is subjected to a controllable air flow. However, this is not the only possible way to alter the penetration depth of the tuft 21 into the clothing 143 of the opening cylinder 141. A further possibility of reducing the penetration depth of the tuft 21 into the clothing of the opening cylinder 141 consists in constructing the entire feed apparatus 13 or indeed only a part thereof, e.g. the feed trough 131, to be adjustable, for example in that the latter can be tilted about the axis 132 somewhat away from the opening cylinder 141. An adjustment apparatus 133 attached to the feed apparatus 13 or the feed trough 131 can pivot the feed apparatus 13 or the feed trough 131 far enough away from the opening cylinder 11 for the penetration depth of the tuft 21 to be reduced precisely by the desired measurement, on the basis of a suitable control signal (see line 35) of the control apparatus 30.

Matched to the release of the sliver 2, the control apparatus 30 emits a suitable signal to the adjustment apparatus 133, whereupon the latter suddenly pivots the feed apparatus 13 slightly away from the opening cylinder 141 and the penetration depth of the tuft 21 into the clothing 143 of the opening cylinder 141 is correspondingly reduced. During the sudden pivoting procedure, a smaller quantity of fibres is delivered to the spinning rotor 110. Timed to the release of the sliver 2 and the pivoting of the feed apparatus 13 or of the feed trough 131, the thread is supplied to the fibre collection surface 17 and taken off therefrom again, as a result of which formation of a thick point is countered and this thick point is compensated completely, or at least reduced. Then, if desired, a countering effect can be achieved by sudden pivoting of the tuft 21 into the clothing 143 of the opening cylinder 141.

Figure 4:
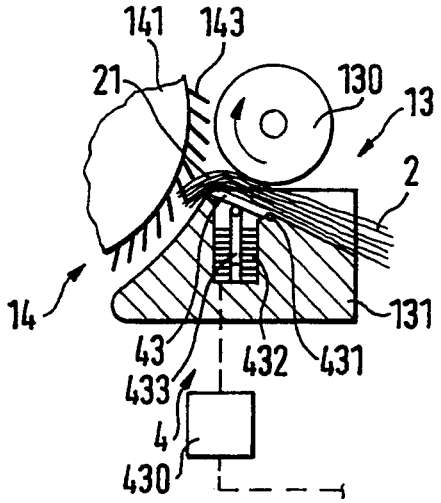
FIG. 4 is a side view of another embodiment of the penetration depth alteration apparatus according to the invention.

In accordance with FIG. 4, it is also possible to provide at the outlet of the feed trough 131 opposite the sliver 2 a guide surface 43, preferably in the form of a metal plate, which may be advanced by a greater or lesser distance with respect to the feed roller 130 by an adjustment apparatus 430. The adjustment of the guide surface 43, which may be coupled by means of a pivot axis 431 to the feed trough 131, can for example be effected by an armature 433 of an electromagnetic apparatus 432, which armature is coupled to the guide surface 43.

Before the piecing procedure, the guide surface 43, which is part of the penetration depth alteration apparatus 4, is displaced by the adjustment apparatus 430 into its end position, its upper position as regards FIG. 4, where the penetration depth of the tuft 21 into the clothing 143 is the greatest. To form the joint, the control apparatus 30 then emits a pick-up signal to the adjustment apparatus 430, whereupon the latter, by way of the electromagnetic apparatus 432, switches the guide surface 43 over into a normal operating position somewhat further from the feed roller 130. During this switchover, the penetration depth of the tuft 21 into the clothing 143 is reduced, and the desired reduction of the fibre flow is achieved at precisely that moment when the joint is formed. Then, depending on the speed of the switchover into the opposite direction, the fibre flow can be increased briefly and thus perceptibly or imperceptibly slowly.

Figure 10:
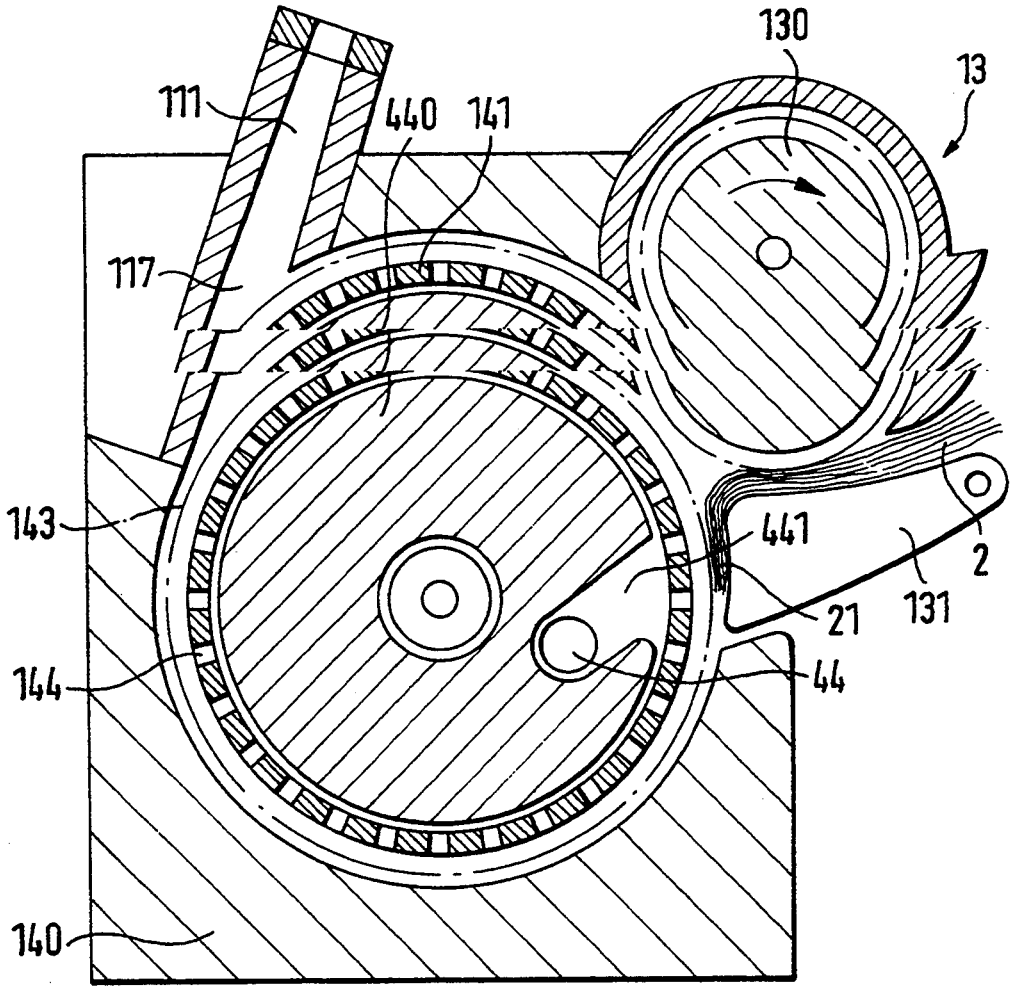
FIG. 10 is a side sectional view of a fibre feed and opening apparatus having a modified penetration depth alteration apparatus.

A further pneumatically operating penetration depth alteration apparatus 4 is explained with the aid of FIG. 10. In this embodiment, the opening cylinder 141 is constructed as a perforated hollow body with openings 144 in the peripheral wall. Connected to the interior of the opening cylinder 141 is a suction channel 44 which is attached to an underpressure source (not illustrated) whereof the effect can be switched on and off—in particular by interposition of a switching valve (not shown). Arranged to be stationary within the opening cylinder 141 is an insert 440 which has a suction channel 441, oriented from the mouth of the suction channel 44 within the opening cylinder 141 towards the inside of the opening cylinder 141 in the longitudinal region of the tuft 21.

In order to be able to draw the tuft 21 deeper into the clothing 143 of the opening cylinder 141, an underpressure is brought into effect in the suction channels 44 and 441. When the tuft 21 is to be returned to the starting position, this suction-air flow is switched off.

In an analogous way, instead of a suction-air source it is also possible to provide an overpressure source so that the tuft 21 can be brought out of the normal position into the position of smaller penetration depth by overpressure.

In order to increase the penetration depth alterations, as an alternative both in the case of the apparatus according to FIG. 10 and in the apparatus shown in FIGS. 2 and 3, suction and compressed air can also be used alternately, while neither compressed nor suction air is used in a neutral middle penetration depth of the tuft 21.

As the above description shows, within the scope of the present invention the process and apparatus can be modified in a variety of ways, in particular by replacing features by equivalents or by other combinations of the individual features. Thus, for example, it is also possible to combine the effects of a plurality of apparatus to form a common penetration depth alteration apparatus 4. Thus, FIG. 1 shows an underpressure source 32 having an underpressure line 18 which is additionally provided for the compressed-air source 42 and the outlet opening 41. It will be appreciated that the apparatus forming the common penetration depth alteration apparatus 4 must be synchronized in their functions by way of the control apparatus 30.

However, it is not only possible to group together pneumatically operating apparatus to form a common penetration depth alteration apparatus 4 with synchronized function. Thus, it is quite possible to combine the apparatus shown in FIG. 4 with the underpressure line 18 or indeed with the outlet opening which can be acted upon by compressed air, in accordance with FIGS. 2 and 3.

Furthermore, it is also possible to provide, in the case of such a combined penetration depth alteration apparatus 4, for the response time points and response durations to be made to differ from one another by means of the control apparatus 30, in order, for example in the case of a joint P according to FIG. 7, to counter both the thick point brought about by $B_{F2}$ and the thick point $D_1$ on the one hand and the thin point $D_2$ on the other hand. As FIG. 7 clearly shows, here different response moments and possibly also times are required for the response of the penetration depth alteration apparatus 4.

Instead of two underpressure sources 116, 32 (FIG. 1), it is also possible to use a single underpressure source which can then be attached in each case by way of a separate switching valve 115 and 181 respectively selectively to the underpressure line 114 or the underpressure line 18. Since underpressures of different size are required in the two underpressure lines 114 and 18, a choke valve must additionally be provided in the line 114, the function of which is to generate the required underpressure drop.

As a rule, if the fibre flow is controlled by altering the penetration depth of the tuft 21 into the clothing 143 of the opening cylinder 141, no account needs to be taken of the state of equilibrium between the sliver supply to the opening cylinder 141 and the fibre flow supply to the fibre collection surface, because of the very rapid alteration required in the penetration depth of the tuft 21. In individual cases, however, it may be advantageous before altering the penetration depth of the tuft 21 into the clothing 143 of the opening cylinder 141 to wait until such an equilibrium has arisen, for example by fibre flow switchover of a full fibre flow or by pre-feeding and renewed brief switching off of the delivery apparatus 13 directly before altering the penetration depth of the tuft 21 into the clothing 143 of the opening cylinder 141.

In accordance with the example embodiments described, a movable maintenance apparatus 3 is provided on which the piecing apparatus and its control apparatus 30 are located. If, in the case of relatively simple machines, e.g. test machines or apparatus, no such maintenance apparatus 3 is provided, then the elements described are assigned directly to the open-end spinning machine 1 or the spinning point 10, if appropriate two adjacent spinning points 10 together.

We claim:

1. An open-end spinning apparatus for spinning thread from fiber, comprising:

(a) an opening cylinder having clothing disposed about its periphery disposed in an opening cylinder housing;

(b) a feeding apparatus disposed upstream of said opening cylinder for feeding a tuft of sliver to said cylinder;

(c) a fiber collection surface disposed downstream from said cylinder for receiving fibers from said cylinder;

(d) an underpressure source associated with said fiber collection surface;

(e) a fiber feeding channel connecting said fiber collection surface to said opening cylinder for guiding fibers from said opening cylinder to said fiber collection surface;

(f) a piecing apparatus for piecing up broken ends of said thread associated with said open-end spinning apparatus;

(g) a depth penetration apparatus for controlling the depth said tuft of said sliver penetrates into said clothing; and (h) control means operably configured with said depth penetration apparatus to coordinate the depth of said sliver tuft into said clothing during piecing, said depth control apparatus controllable in a first depth control configuration to maintain said sliver tuft at a first predetermined depth into said clothing, and controllable in a second depth control configuration to withdraw said fiber tuft from said first depth to a second predetermined depth which is less than said first predetermined depth, said control means further comprising timing means configured with said depth penetration apparatus to coordinate switching between said first depth control configuration and said second depth control configuration so that said fiber tuft is withdrawn to said second depth as fibers are simultaneously introduced to said fiber collection surface for piecing so that temporarily fewer fibers reach said fiber collection surface during piecing.

2. An open-end spinning apparatus as set forth in claim 1, wherein said depth penetration apparatus comprises an overpressure source which is controlled by said control means and which opens in the area of said tuft in said opening cylinder housing.

3. An open-end spinning apparatus as set forth in claim 2, wherein said overpressure source comprises a pneumatic source connected to the interior of said opening cylinder and said opening cylinder has a perforated outer surface.

4. An open-end spinning apparatus as set forth in claim 2, wherein a pneumatic source opens into a feed trough which comprises part of said feeding apparatus and directs pneumatic currents substantially radially with respect to said opening cylinder.

5. An open-end spinning apparatus as set forth in claim 1, wherein said depth penetration apparatus comprises a second underpressure source which is controlled by said control means and which is effective in said opening cylinder housing.

6. An open-end spinning apparatus as set forth in claim 5, wherein said second underpressure source is associated with said underpressure source for said fiber collection surface to control the depth penetration of said tuft in an overlapping manner.

7. An open-end spinning apparatus as set forth in claim 5, wherein said depth penetration apparatus is effective in the fiber transport path between said feeding apparatus and said fiber collection surface.

8. An open-end spinning apparatus as set forth in claim 7, wherein said second underpressure source is connectable to a suction-air opening in the peripheral wall of said opening cylinder housing.

9. An open-end spinning apparatus as set forth in claim 8, wherein said suction air opening is arranged in the longitudinal region of said tuft.

10. An open-end spinning apparatus as set forth in claim 9, wherein said suction-air opening is covered by a screen.

11. An open-end spinning apparatus as set forth in claim 8 wherein a fiber collection receptacle is disposed between said suction-air opening and said second underpressure source.

12. An open-end spinning apparatus as set forth in claim 8, wherein means are provided for connecting said suction-air opening to said second underpressure source and an overpressure source selectively.

13. An open-end spinning apparatus as set forth in claim 1, wherein said control means is disposed on a maintenance apparatus which moves alongside a plurality of open-end spinning apparatus.

14. An open-end spinning apparatus as set forth in claim 1, wherein said depth penetration apparatus comprises an adjustment apparatus for said feeding apparatus.

15. An open-end spinning apparatus as set forth in claim 1, wherein said depth penetration apparatus comprises an adjustable baffle disposed in the region of said tuft.

16. An open-end spinning apparatus as set forth in claim 1, further comprising apparatus for determining the state of said tuft at the beginning of the piecing and connected to said control means.

17. An open-end spinning apparatus as set forth in claim 16, wherein said apparatus for determining the state of said tuft is connected by said control means to said depth penetration apparatus.

* * * * *